US006390909B2

(12) United States Patent
Foster et al.

(10) Patent No.: US 6,390,909 B2
(45) Date of Patent: May 21, 2002

(54) DISK FOR CONDITIONING POLISHING PADS

(75) Inventors: Bernard Foster, Elkton, MD (US); Paul J. Freeman, Landenberg, PA (US)

(73) Assignee: Rodel Holdings, Inc., Wilmington, DE (US)

( * ) Notice: Subject to any disclaimer, the term of this patent is extended or adjusted under 35 U.S.C. 154(b) by 0 days.

(21) Appl. No.: 09/819,115

(22) Filed: Mar. 28, 2001

Related U.S. Application Data

(60) Provisional application No. 60/194,043, filed on Apr. 3, 2000.

(51) Int. Cl.[7] ..... B24B 21/18

(52) U.S. Cl. ..... 451/444; 451/41; 451/56; 451/60; 451/262; 451/287; 451/288; 451/443

(58) Field of Search ..... 451/41, 56, 60, 451/262, 287, 288, 291, 443, 444

(56) References Cited

U.S. PATENT DOCUMENTS 6,001,008 A 12/1999 Fujimori et al.

*Primary Examiner*—Joseph J. Hail, III
*Assistant Examiner*—Shantese McDonald
(74) *Attorney, Agent, or Firm*—Gerald K. Kita; Konrad Kaeding; Kenneth A. Benson

(57) ABSTRACT

A conditioning disk including a unitary thermoplastic polymer sheet material cut a unitary circular plate formed with gear teeth along its circular edge, and formed with block form protrusions that are impelled in a sweeping motion by rotation of the unitary plate as a planetary gear in meshed engagement with a sun gear and a ring gear of a polishing apparatus.

3 Claims, 4 Drawing Sheets

DISK FOR CONDITIONING POLISHING PADS

CROSS REFERENCE TO RELATED APPLICATION

This application claims the benefit of US Provisional Patent Application No. 60/194,043 filed Apr. 3, 2000.

FIELD OF THE INVENTION

The invention relates to apparatus and a method for conditioning polishing pads, and restoring the surface texture of a polishing pad.

DISCUSSION OF RELATED ART

During the process of manufacturing a memory disk, double-sided polishing is used to remove unwanted material from opposite sides of a substrate, typically of aluminum, nickel phosphorous or glass, and to produce a flat, smooth surface. Polishing of memory disks generally takes the form of double-sided polishing wherein a chemically active, abrasive-containing slurry is used in conjunction with two polishing pads. In a typical arrangement a polishing pad is adhered to each, an upper and a lower rotatable platen. The workpieces are held in a relative position by carriers which are placed between the pads. The slurry is fed onto the surface of the polishing pads. Polishing is affected by rotating the platens and the disks relative to each other, with the slurry generally dispensed throughout the polishing step of the cycle.

During the polishing process, properties of the polishing pads change. The pore structure of the polishing pad surface wears down, and the surface of the pad becomes smooth as a result of polishing byproducts, such as removed substrate material, becoming embedded in the surface. This results in a polishing surface which substantially reduces polishing performance. To restore the pads' polishing performance, the pads are conditioned.

Conditioning is a technique wherein a polishing pad is treated typically between polishing cycles to restore its properties and thereby restore its polishing performance. Traditional pad conditioning involves the use of brushes to wipe the pad surface free of debris. However, the traditional method breaks down the pore walls due to intrusion into the pore structure from the bristles.

Prior to the invention, a polishing pad was conditioned by brushing with bristles to remove polishing debris imbedded in the pad, and to clean the pores of the pad. The pores of a poromeric polishing layer become torn when the pad is cleaned by bristles of a brush type conditioning apparatus that is used to remove polishing debris and to condition the polishing layer. The bristles are urged to intrude into the pores, and sometimes to intrude into the pressure sensitive adhesive that secures the polishing layer to an underlying base layer of the polishing pad. The pores transport slurry during a polishing operation. Tearing of the polymer bordering the pores creates keyholes that lose an ability of the pores to hold slurry during a polishing operation. Tearing is severe enough in some areas of the polishing layer that the polishing layer is torn away from the underlying layer. Consequently, the polishing pad has a reduced useful life, caused by the brush type conditioning apparatus.

What is desired is a conditioning apparatus that fits with a known polishing machine, and that utilizes a ring gear and a sun gear of the known polishing machine to drive the conditioning apparatus without a requirement for modification of the conditioning apparatus.

SUMMARY OF THE INVENTION

The present invention does not use bristles that cause the tearing of the pore walls and therefore does not reduce the useful life of the polishing pad.

According to the invention, a conditioning disk is fabricated from a unitary circular plate formed with gear teeth along its circular edge, and formed with block form protrusions on at least one of two opposite major surfaces of the plate, which protrusions are impelled in a sweeping motion by rotation of the unitary plate as a planetary gear in meshed engagement with a sun gear and a ring gear of a polishing apparatus.

BRIEF DESCRIPTION OF THE DRAWINGS

Embodiments of the invention will now be described by way of example with reference to the following detailed description taken in conjunction with the accompanying drawings. The foregoing summary, as well as the following detailed description of the preferred embodiments, will be better understood when read in conjunction with the appended drawings. For the purpose of illustrating the invention, there are shown in the drawings embodiments which are presently preferred, it being understood, however, that the invention is not limited to the specific methods and instrumentalities disclosed. In the drawings.

DETAILED DESCRIPTION

Figure 3:
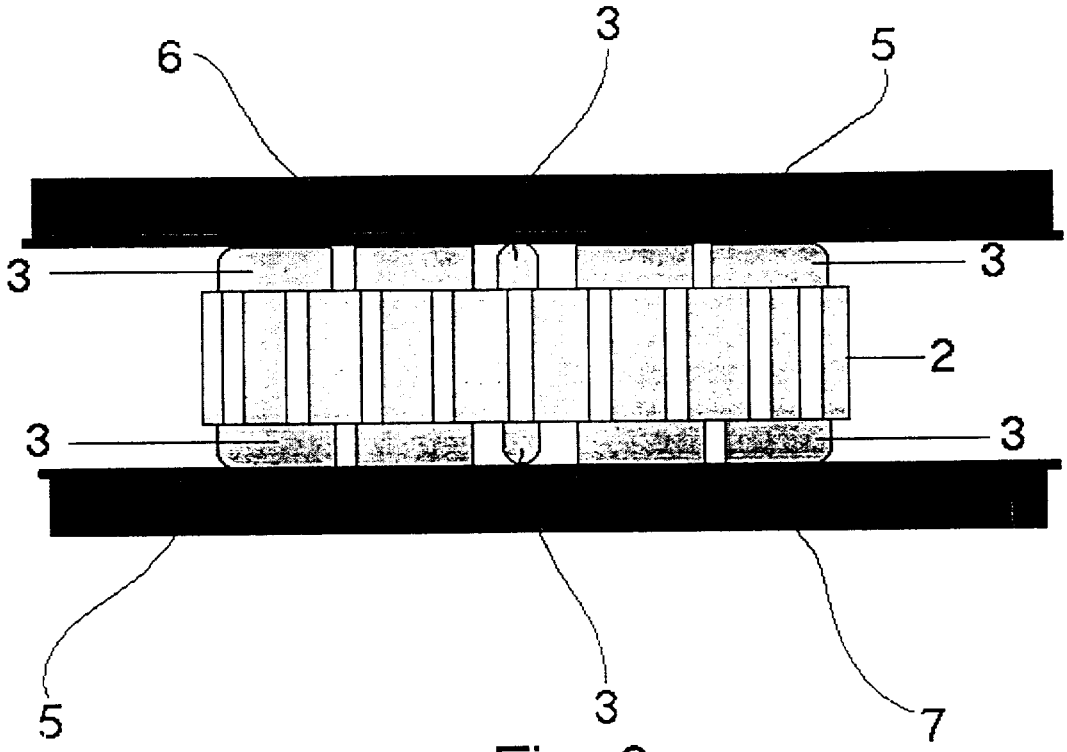
FIG. 3 is a side view of the conditioning disk.
Figure 4:
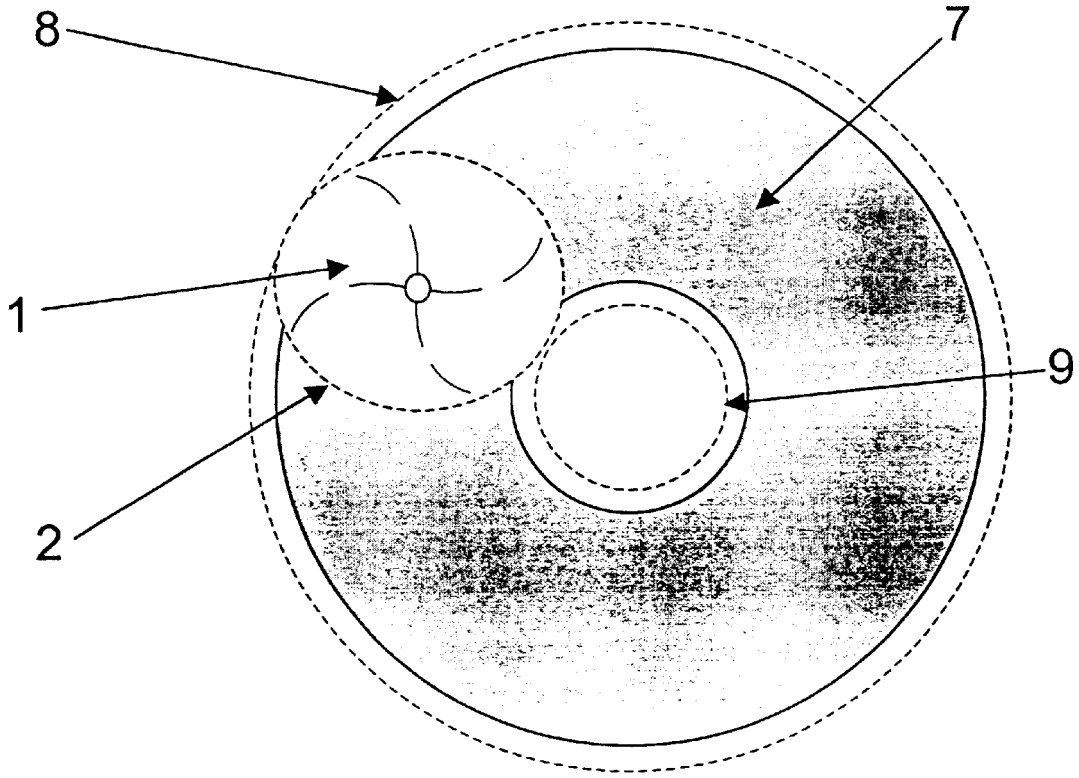
FIG. 4 is a top view of the lower platen on a polishing machine.

FIG. 3 shows a side view of the conditioning disk used on a double-sided polishing machine having an upper 6 and a lower 7 platen, each having a pad 5 adhered thereto. At the conclusion of the rinse step of a polishing cycle, the upper platen 6 is raised and the workpieces and carriers are removed from the lower platen 7. The conditioning disks 1 are then placed onto the lower platen 7. FIG. 4 shows the conditioning disk placed on the lower platen 7 in such a manner so that the gear teeth 2 of the conditioning disk 1 engage with an outer gear 8 (called the ring gear), and an inner gear 9 (called the sun gear). The gears and platens can rotate in the same or opposite directions and at variable speeds. The rotation of the ring and sun gears drives the conditioning disk around the pad. A minimum of one conditioning disk 1 can be utilized during the conditioning step, however, an item of similar thickness will need to be placed on the opposite side of the lower platen 7 to provide proper support to the upper platen 6. The upper platen 6 is then lowered and a pre-determined downforce is applied. A rinsing liquid, such as deionized water, is then dispensed onto the pad surfaces. The gear drive motors of the polishing machine are then engaged and the conditioning disks rotate about the surface of the polishing pads. After a set time, the gear drive motors and the rinsing liquid are turned off, the upper platen 6 is raised, and the conditioning disks 1 are removed. The pad surfaces 5 are then rinsed to remove any residual debris. The carriers and new unpolished workpieces are then placed onto the lower platen 7 and the polishing cycle repeats.

Figure 1:
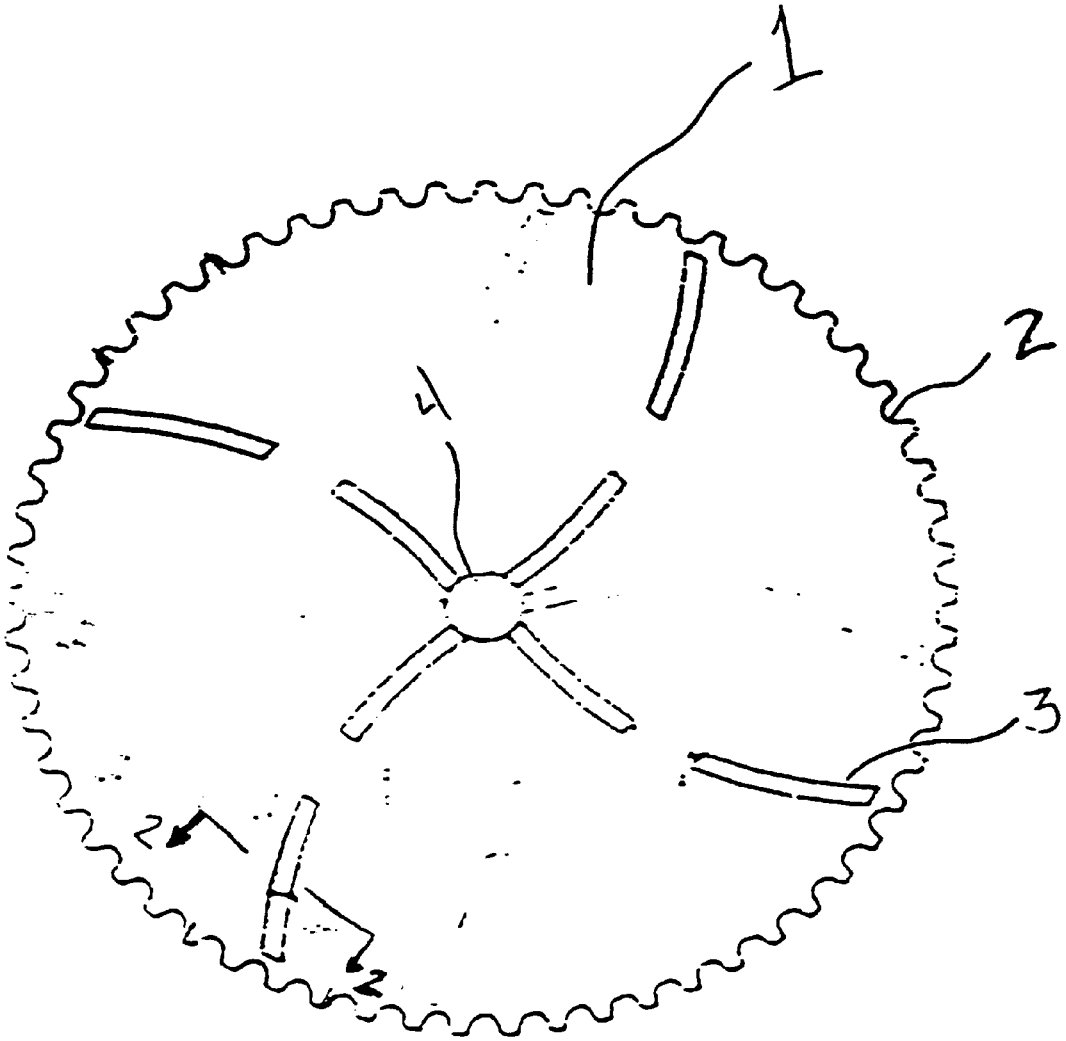
FIG. 1 is the top view of the conditioning disk.

Refer to FIG. 1. The conditioning disk 1 of this invention is machined on a Haas CNC (Computer Numerical Control) Machining Center from a thermoplastic polymer sheet, such as a polyamide, an acetal resin such as Delran®, a fluorocarbon polymer filled polyamide such as Teflon®-filled nylon, or a polyolefin such as ultra-high molecular weight (UHMW) polyethylene. The thickness of the thermoplastic polymer sheet can be from 0.25" to 3" thick, more preferably between 0.50" and 2", and most preferably between 0.75" and 1.25". The polymer sheet is cut into disks, wherein each disk has a diameter in the range of 3" to 36", more preferably between 6" and 24", and most preferably between 9" and 15". A 1" diameter hole 4 is drilled through the center of the disk to facilitate the machining process, but does not affect performance and its presence or absence should not be viewed as limiting. A conditioning disk 1 comprises, a unitary circular plate formed with gear teeth 2 along its circular edge, and formed with block form protrusions in the form of wiper arms 3 on opposite major surfaces of the plate, which protrusions are impelled in a sweeping motion by rotation of the unitary plate as a planetary gear in meshed engagement with a sun gear 9 and a ring gear 8 of a known polishing apparatus.

Gear teeth 2 are machined along the circumference of the disk. The radius of the teeth 2 can be between 0.05" and 0.75", depending upon the polishing machine design that determines the gear tooth size of the conditioning disk, and the dimensions presented in this disclosure should not be viewed as limiting.

Figure 2:
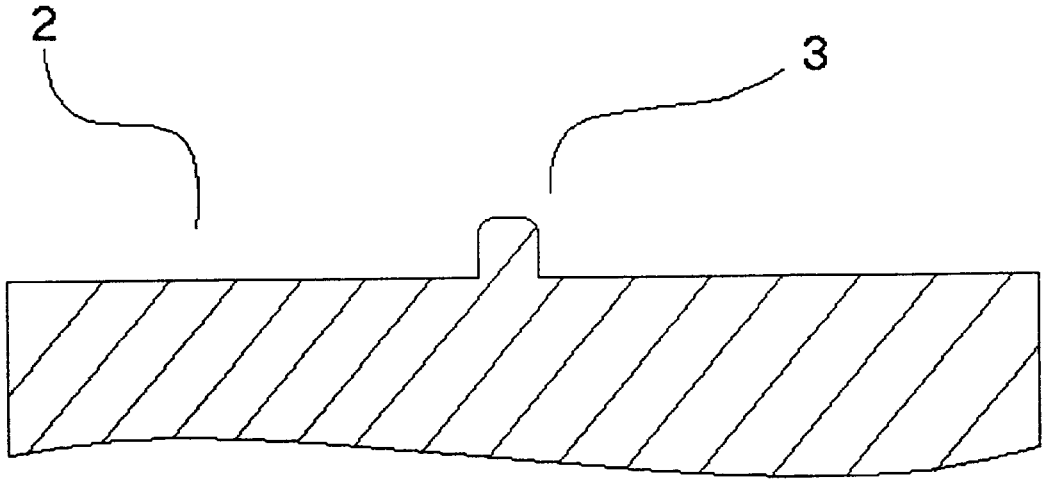
FIG. 2 is an enlarged cross-sectional view of the disk of FIG. 1, taken along line 2—2.

The next features to be machined onto the conditioning disk are the block form protrusions that form wiper arms 3 as shown in FIG. 2. The wiper arms 3 are formed by machining away material from the surface of the disk to a predetermined depth and in a pattern which leaves a raised area in the desired dimension of the wiper arm 3. The depth to which the material is machined is between 0.0625" to 0.75", more preferably 0.125" and 0.5", and most preferably between 0.1875" and 0.3125". After machining the gear teeth 2 (FIG. 1) and wiper arms 3, all edges are chamfered and any residual flashing is removed. The conditioning disk 1 is then reversed and the opposite surface is machined to create the wiper arms 3 on that side. The number of wiper arms 3 can be from 2 to 20, more preferably between 3 and 10, and most preferably between 4 and 8. The wiper arms 3 can have various configurations, to include: spanning across the surface of the disk, radiating linearly from the center, or radiating in an arc from the center. The wiper arms 3 facilitate the removal of debris by compressing the polishing pad material as they rotate across the pad surface. As the pad returns to an uncompressed state, any debris caught in the pores of the pad are ejected, swept away by the wiper arms 3, and rinsed off of the pad.

The invention relates to a polishing pad conditioning disk for use with a double-sided polishing machine comprising an upper platen with a polishing pad adhered thereto, a lower platen with a polishing pad adhered thereto, a ring gear, and a sun gear. The conditioning disk is further adapted for use with a single sided polishing machine with solely a single platen with a corresponding polishing pad adhered thereto. The conditioning disk comprises a thermoplastic polymer sheet material, which is cut into a disk, each disk having raised areas on both major surfaces, for a double sided polishing machine, or solely on one major surface, for a single sided polishing machine, to facilitate the removal of debris, and gear teeth along the circumference which engage and rotate with the ring and sun gears of the polishing apparatus.

The present invention relates to a conditioning disk to be utilized during the manufacture of memory disks, semiconductors, and the like on a double-sided polishing machine such as the Speedfam 12B Double-Side Polisher. A typical polishing cycle consists of a pad pre-wetting step, a polish step, a rinse step, and generally a pad conditioning step. The conditioning disk is typically used between polishing cycles.

Embodiments of the invention having been described, other embodiments and modifications of the invention are intended to be covered by the spirit and scope of the appended claims.

What is claimed is:

1. A conditioning disk comprising: a unitary circular plate formed with gear teeth along its circular edge, and formed with block form protrusions on at least one of two opposite major surfaces of the plate, which protrusions are in the form of wiping arms impelled in a sweeping motion by rotation of the unitary plate as a planetary gear in meshed engagement with a sun gear and a ring gear of a polishing apparatus.

2. The conditioning disk as recited in claim 1 wherein, the wiping arms extend radially of the major surfaces of the plate.

3. The conditioning disk as recited in claim 1 wherein, the wiping arms are arranged in a repeating pattern on the major surfaces of the plate.

* * * * *